United States Patent [19]

Coster et al.

[11] 4,078,804

[45] Mar. 14, 1978

[54] VARIABLE SURFACE BOARD GAME

[76] Inventors: Ora Coster; Theo Maurice Simon Coster, both of 7 Beith Horon Str., Tel-Baruch, Tel-Aviv, Israel

[21] Appl. No.: 680,508

[22] Filed: Apr. 26, 1976

[51] Int. Cl.[2] ..... A63F 3/00

[52] U.S. Cl. ..... 273/284 GA; 273/236; 273/290

[58] Field of Search ..... 273/135, 134

[56] References Cited

U.S. PATENT DOCUMENTS

| | | | |
|---|---|---|---|
| 452,708 | 5/1891 | Huff | 273/135 AA |
| 1,799,843 | 4/1931 | Bradford et al. | 273/135 R |
| 3,367,662 | 2/1968 | Charles et al. | 273/134 AD |
| 3,705,727 | 12/1972 | Breslow | 273/135 B |
| 3,948,524 | 4/1976 | Ladd et al. | 273/135 R |

*Primary Examiner*—Richard C. Pinkham
*Assistant Examiner*—Harry G. Strappello
*Attorney, Agent, or Firm*—Browdy and Neimark

[57] ABSTRACT

A board game comprises in combination a playing board, playing stations marked on the board respectively identified by locating coordinates, a series of station cards to be randomly distributed on the playing stations each station card bearing on its face playing information and manually manipulatable devices bearing coordinate identification symbols for making a chance selection of at least one station locating coordinate.

7 Claims, 9 Drawing Figures

Figure 1:
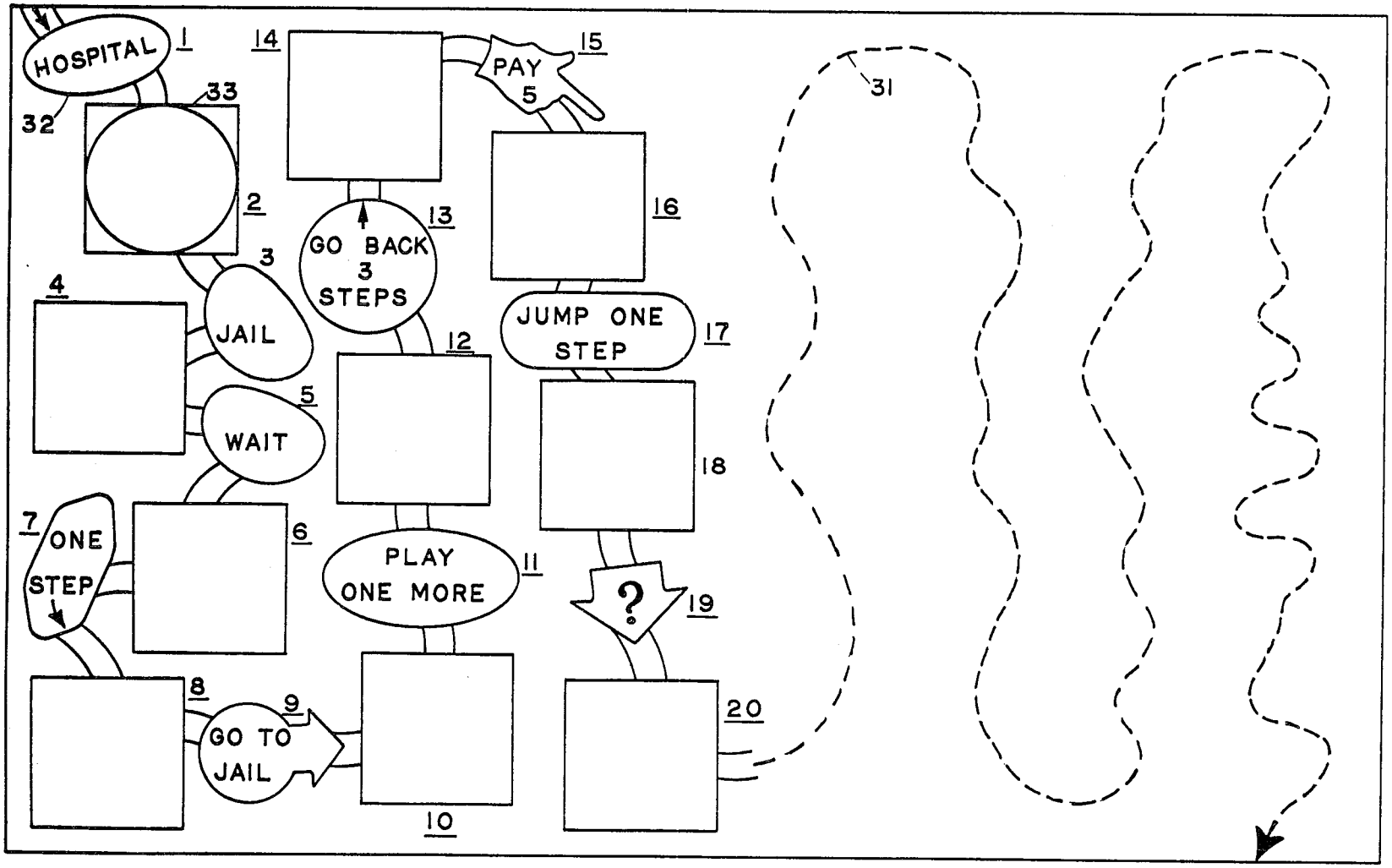

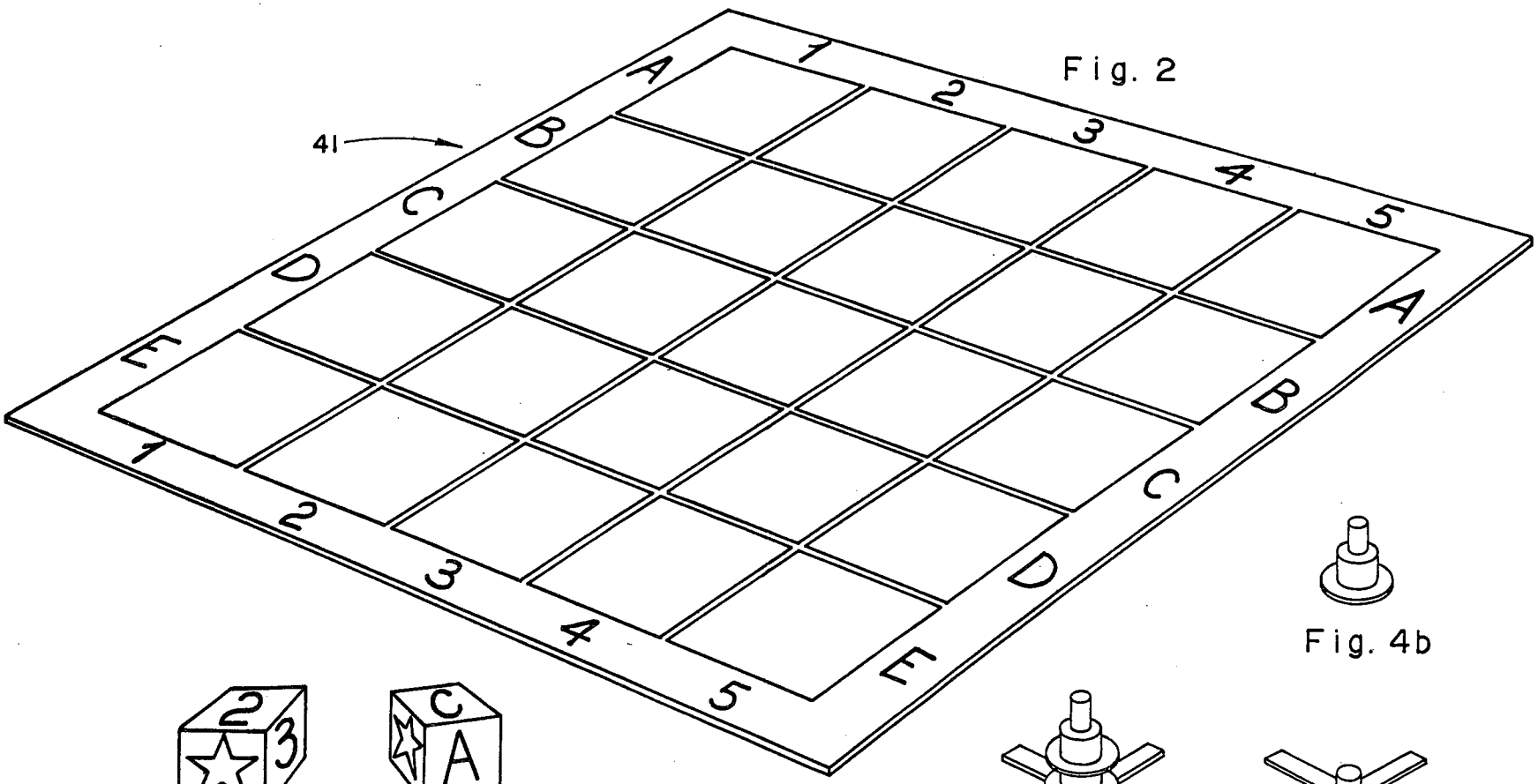
Fig. 2
Fig. 4b
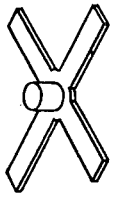
Fig. 4a
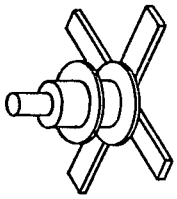
Fig. 4c
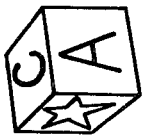
Fig. 3b
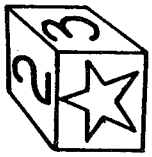
Fig. 3a

VARIABLE SURFACE BOARD GAME

This invention concerns an improved board game of the kind having a playing board presenting a game surface with playing stations marked thereon, each station being identified by one or more locating coordinates, there being provided manually manipulatable means such as, for example, one or more dice for making a chance selection of the station locating coordinates, the or each player moving from station to station in accordance with the chance selection provided by the manually manipulatable means, the progress of the players being determined, on the one hand by the chance selection of stations and, on the other hand by the playing instructions, information or the like associated with each station.

In known games of this kind the playing stations are marked on the playing board in such a way that characteristic instructions or playing information are associated with each station in a predetermined fixed manner and are visible to the players from the very outset of the game. With such known games and, after the players have familiarized themselves with the game surface presented by the playing board, the sole element of variation in play is provided by the chance selection afforded by the manually manipulatable means. The game surface presented by the board itself however and its associated playing stations remains invariable and this, of necessity reduces the amount of interest in the game.

It is accordingly an object of the present invention to provide a new and improved board game in which the above referred to disadvantage is substantially minimized.

According to the present invention there is provided a board game comprising in combination a playing board, playing stations marked on the board respectively identified by locating coordinates, a series of station cards to be distributed on the playing stations so that the board and the distributed station cards present a game surface, each station card bearing on its face playing information, manually manipulatable means bearing coordinate identification symbols for making a chance selection of at least one station locating coordinate, and marker means for location on said game surface so as to mark selected playing stations.

Thus with a board game in accordance with the invention the identity of the playing stations, having fixed locations, varies preferably randomly, from game to game in accordance with the distribution of the station cards prior to their location on the playing stations and in this way the players are effectively presented with a fresh game surface for each game. In this way the interest in the game is maintained and the element of chance involved in play is increased over and above that provided by the use of the manually manipulatable means.

Preferably the station cards are randomly distributed face down on the playing stations, each card being reversed so as to display the associated playing information only when the player lands on the associated station as a result of the chance selection afforded by the manipulatable means.

In accordance with a preferred embodiment of the invention the playing stations are defined by $n$ successive rows and $m$ successive columns of rectangular locations, each station being identified by a row and by a column identification, the manually manipulatable means comprising a pair of dice, a first die having faces upon which coordinates corresponding to the $n$ rows appear and a second die having faces upon which coordinates corresponding to the $m$ columns appear. Preferably the first die has a number of faces greater than $n$ and the second die has a number of faces greater than $m$. Each station card can be arranged to bear information giving a value weighting to the station upon which it is located there being furthermore provided value tokens for use in transactions between the players and between the players and a bank, and marker tokens for use by players in identifying proprietorship of respective stations.

Figure 6:
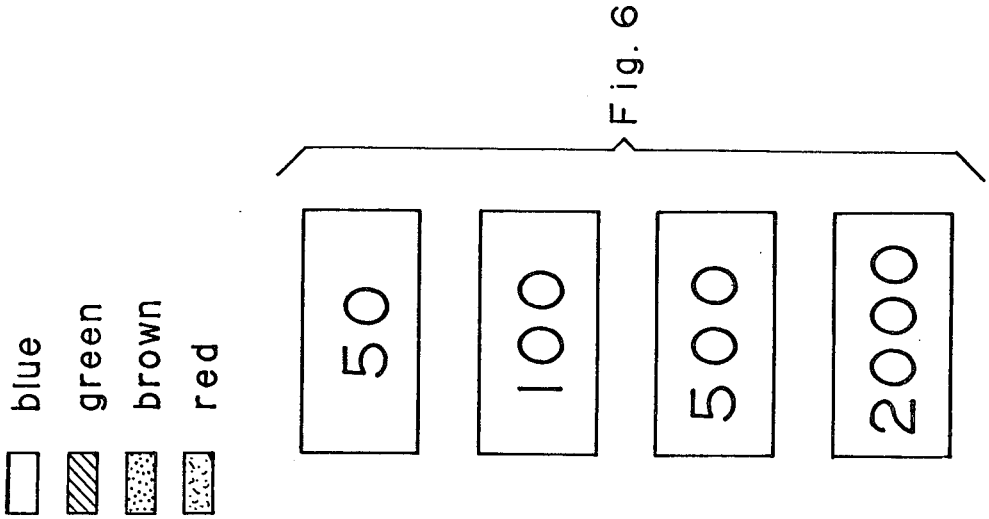
Figure 5:
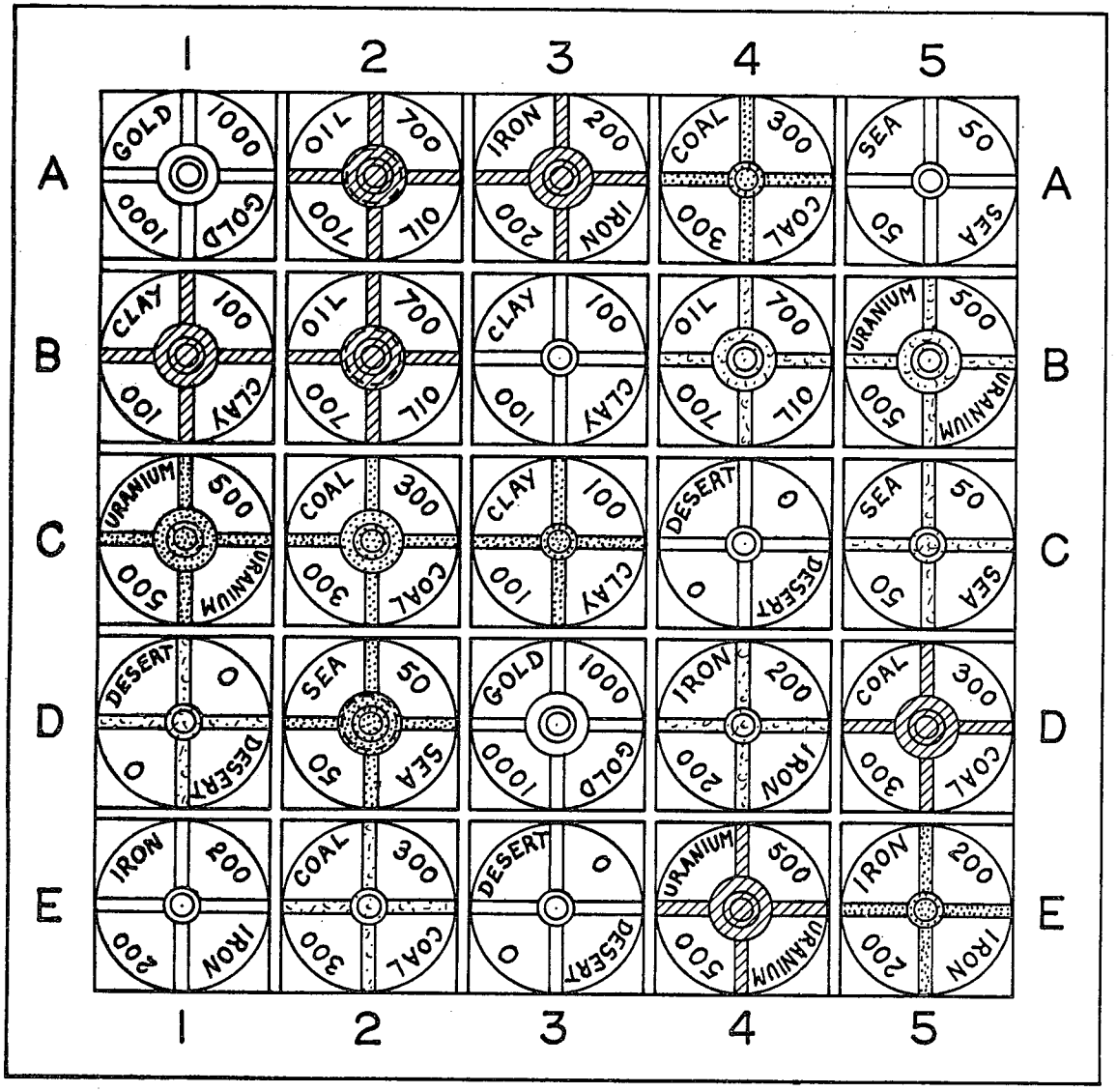

For a better understanding of the present invention and to show how the same may be carried out in practice, reference will be had to the accompanying drawings in which:

FIG. 1 is a schematic plan view of a playing board in accordance with one simplified embodiment in accordance with the present invention, FIG. 2 is a perspective view of a playing board in accordance with a second embodiment of board game in accordance with the present invention, FIGS. 3*a* and 3*b* are perspective views of dice used in the board game in accordance with the invention, FIGS. 4*a* and 4*b* are perspective views of marker tokens used with the board game in accordance with the invention, FIG. 4*c* is a perspective view of a plurality of marker tokens combined one upon the other, FIG. 5 is a plan view from above of the playing board shown in FIG. 2 in an advanced state of play, and FIG. 6 is a schematic representation of value tokens for use in the board game in accordance with the invention.

FIG. 1 shows a very simple form of board game in accordance with the present invention, wherein a predetermined meandering path 31 has marked thereon playing stations, each identified by a characteristic number, a first set of playing stations 32 bearing fixed invariant playing information and a second set of playing stations 33 adapted to have located thereon station cards to be randomly distributed on the playing station 33 and to bear playing information. The board and the station cards disposed thereon together present a game surface on which play is to take place.

The game such as that illustrated schematically in FIG. 1 is played in a conventional manner by, for example, the throwing of dice, the player proceeding from station to station in accordance with the number shown by the thrown dice. Where, however, the player lands on a station 32 he proceeds in accordance with the fixed, invariant information shown by that station, but where he lands on a station 33 the future progress of his movements depends on the identity of the playing card to be found in that station and this identity varies in a random manner from game to game. In this way the basically simple and elementary type of game shown in FIG. 1 of the drawings has, added to the intrinsic interest afforded by the throwing of the dice, an additional element of chance which cannot be predicted, afforded by the fact that the playing stations vary from game to game in accordance with the random distribution of the station cards.

A preferred embodiment of a board game in accordance with the present invention will now be described in detail with reference to FIGS. 2–6 of the accompanying drawings.

This board game which is identified by the trademark "Territory" comprises a playing board 41 on which are marked five orthogonally directed rows and columns of playing stations, the rows being identified by the letters A, B, C, D and E and the columns being identified by the numerals 1, 2, 3, 4 and 5. In consequence the board is formed with 25 playing stations, each playing station being identified by a pair of coordinates consisting of a letter and of a numeral. Thus, for example, the upper lefthand corner station is identified by the coordinates A1 whilst the bottom righthand corner station is identified by the coordinates E5 and so on. The game is furthermore provided with a set of (25) station cards which, in FIG. 5 of the drawings are shown distributed face up on the respective playing stations. Each playing card has shown on it a commodity or utility and an associated value weighting. Thus the playing cards shown in FIG. 5 comprise three cards representing "sea" having each a value weighting of 50, three cards representing "clay" having each a value weighting of 100, four cards representing "iron" having each a value weighting of 200, four cards representing "coal" having each a value weighting of 300, three cards representing "uranium" having each a value weighting of 500, three cards representing "oil" having each a value weighting of 700, two cards representing "gold" having each a value weighting of 1000 and three cards representing "desert" having each a value weighting of 0.

The game is played with a pair of dice shown in FIGS. 3*a* and 3*b*, one die shown in FIG. 3*a* bearing upon five of its faces the numerals 1 to 5, respectively, and on the sixth face a star representing a "joker" whilst the second die shown in FIG. 3*b* bearing on five of its faces the letters A to E, respectively, and on the sixth face a star representing a "joker".

FIG. 4*a* is a cruciform type marker token having a central projection and FIG. 4*b* shows a marker token cap having a lowermost recess and an uppermost projection such that a marker cap can be fitted onto the projection of a cruciform token and be fitted in its turn into the recess formed in a subsequent marker token cap as shown, for example, in FIG. 4*c*.

As seen in FIG. 5 of the drawings the marker tokens and their caps are formed of differing colours for use by, and so as to identify, differing players.

FIG. 6 shows schematically differing denominations of value tokens (for example simulating bank notes or the like) to be used by the players.

The basic game is prepared for play as follows: The 25 station cards are shuffled so as to have a random distribution and are then distributed, face down on the 25 playing stations. Each player then receives from the bank for which one of the players is responsible, a fixed sum of value tokens and a collection of marker tokens and marker token caps of a particular colour thereinafter to be identified with that player.

After having determined, by any of the conventional means employed in board games, which player is to start, the first player throws both dice and, in accordance with the coordinates shown by the thrown dice a playing station is identified whereupon that player turns the card so as to reveal the playing information; in the case of the present game, a commodity and a value weighting. The player has then the option of acquiring the station which he does by paying the bank a fixed value whereupon he places on the station thus acquired a marker token of his identifying color. On any subsequent occasion that the player lands on one of his own stations he can increase his investment in that station by acquiring, for an appropriate payment to the bank a marker token cap which he fits onto the marker token or, if a marker cap has already been fitted onto the marker token, onto the last marker cap fitted.

When any player lands on a station owned by another player he pays to the player owning that station the value indicated thereon for one marker cap and a multiple of that value for a corresponding multiple of marker caps.

When the thrown dice shows one or more "joker" stars the player throwing that dice has an increased degree of freedom in choosing the station on which to land. Furthermore the rules of the game can provide for the payment from the bank to the player throwing one or more "joker" stars an appropriate amount.

The game continues until all the station cards have been reversed displaying the commodities and value weightings.

It is a prime object of each player to acquire "territory" by which is meant acquiring successive playing stations lying in the same row or column. As seen in FIG. 5 of the drawings stations A2, A3, B1, B2 constitute a single "territory" held by the green player; stations C1, C2, C3, D2 constitute a single "territory" held by the brown player; stations D3 and E3 constitute a single "territory" held by the blue player; and stations B4 and B5 constitute a single "territory" held by the red player.

Where any player lands on any station constituting part of a "territory" of another player then he must pay the owner of the "territory" the sum total of all the investments in all the constituent stations of that "territory".

Whilst as described up to now the progress of the game has been dictated by the random throw of the dice and the random distribution of the station cards, the only element of choice being the decision of the player to what extent to invest on any station on which he has landed, a further element of choice, which involves a certain amount of skill on the part of the players arises in view of the possibilities for players to sell, buy or exchange stations between them. Thus a player may sell his investment to the highest bidder or give a station to cancel a debt. For example, a station of relatively low face value may be very valuable to another player as it may serve to connect various stations so as to form a single "territory".

The winner of the game is the one who remains in the field whilst the others have been forced to retire as a result of debts and bankruptcy.

It will be appreciated that the game just described can be played with a variety of differing playing rules and in consequence no single set of rules need be disclosed in detail in this specification.

Whilst the game has been specifically disclosed for board having 5 rows and 5 columns of stations, games can be designed for differing numbers of stations, though the 5 × 5 orientation is particularly advantageous for use with cubic dice whilst retaining the variability of play provided by die "joker" faces.

Furthermore whilst in the preferred embodiment described above all the stations are to be occupied by station cards the inventive concept extends equally well to a board wherein some of the stations have playing information permanently associated therewith.

It will be realized that the game just described provides a striking example as to how the basic principle of the present invention, namely the reconstruction of the game surface of a playing board afresh for each game can be readily effected. Furthermore, the game just described provides a ready example as to how this principle can be applied in a game whose object is the acquiring of neighboring stations so as to constitute single territories.

We claim:

1. A board game comprising in combination a playing board, playing stations marked on the board respectively identified by locating coordinates, a series of station cards to be distributed on said playing stations so that the board and the station cards distributed thereon present a game surface, each station card bearing on its face playing information, manually manipulatable means bearing coordinate identification symbols for making a chance selection of at least one station locating coordinate, and marker means for location on said game surface so as to mark selected playing stations.

2. A board game according to claim 1 wherein said playing stations are constituted by a series of sets of stations each set comprising a plurality of mutually aligned stations.

3. A board game according to claim 2 comprising intersecting sets of orthogonally directed stations.

4. A board game according to claim 3 wherein said playing stations are defined by *n* successive rows and *m* successive columns of rectangular locations, each station being identified by a row and by a column identification.

5. A board game according to claim 4 wherein said manually manipulatable means comprises a pair of dice, a first die having faces upon which coordinates corresponding to the *n* rows appear and a second die having faces upon which coordinates corresponding to the *m* columns appear.

6. A board game according to claim 5 wherein the first die has a number of faces greater than *n* and wherein the second die has a number of faces greater than *m*.

7. A board game according to claim 1 wherein each station card bears information giving a value weighting to the station upon which it is located and wherein there is furthermore provided value tokens for use in transactions between the players and between the players and a bank, and marker tokens for use by players in identifying proprietorship of respective stations.

* * * * *